US006155546A

United States Patent [19]

Whitener

[11] Patent Number: 6,155,546

[45] Date of Patent: Dec. 5, 2000

[54] TOOL FOR USE IN INSTALLING SILT FENCES

[76] Inventor: Shawn E. Whitener, 4340 Floyd Rd., Austell, Ga. 30106

[21] Appl. No.: 09/037,766

[22] Filed: Mar. 10, 1998

[51] Int. Cl.[7] ..... B25B 1/00

[52] U.S. Cl. ..... 269/3; 119/770

[58] Field of Search ..... 269/3; 2/312, 319; 224/904; 119/770, 857

[56] References Cited

U.S. PATENT DOCUMENTS

| | | | |
|---|---|---|---|
| 2,889,830 | 6/1959 | Raymond | 128/522 |
| 3,941,208 | 3/1976 | St. Germain | 182/3 |
| 5,161,486 | 11/1992 | Brown | 119/770 |
| 5,568,887 | 10/1996 | Gollihue et al. | 224/661 |
| 5,718,189 | 2/1998 | Blake | 119/770 |
| 5,806,466 | 9/1998 | Pintor et al. | 119/770 |

*Primary Examiner*—David A. Scherbel
*Assistant Examiner*—Daniel Shanley
*Attorney, Agent, or Firm*—Thomas, Kayden, Horstemeyer & Risley

[57] ABSTRACT

The present invention provides a tool for installing silt fences. The tool comprises a belt that is worn by a person installing silt fences. The belt comprises a leg harness that attaches to the installer's leg and a hook connected to the leg harness which can be attached, or hooked, around a stake. To install a silt fence, the installer first hammers the first stake of the silt fence into the ground. The installer then places the bottom end of the next adjacent stake of the fence into the ground at the appropriate location and distance away from the first stake. The installer then places the hook around the stake such that the hook passes through an opening between the stake and the fabric material. The installer then moves the leg positioned in the leg harness in a direction away from the stake to be installed, thereby causing the upper portion of the stake to be pulled in a direction away from the first stake, which causes the fence to be pulled tautly toward the installer. The installer then hammers the stake into the ground with a hammer, such as a full-sized sledge hammer. The installation method of the present invention does not require the stake to be held by a person as it is hammered into the ground because the hook holds the stake in position as it is being hammered.

15 Claims, 2 Drawing Sheets

TOOL FOR USE IN INSTALLING SILT FENCES

TECHNICAL FIELD OF THE INVENTION

The present invention generally relates to a tool for installing silt fences and, more particularly, to a belt that can be worn by a person that comprises a leg harness having a hook connected to it that can be hooked around a stake of a silt fence to allow the person to pull the stake into place by moving his or her leg positioned in the leg harness in a direction away from the stake. The hook holds the stake in place while the installer hammers the stake into the ground, thus eliminating the need to have a second person hold the stake while the installer hammers the stake into the ground.

BACKGROUND OF THE INVENTION

Silt fences are installed near waterways and roadways to prevent silt from being washed into waterways and roadways. Many states have laws that mandate that building contractors install silt fences a particular distance away from waterways and roadways. A silt fence generally is comprised of a fabric material having stakes attached to it. The stakes are attached to the fabric material a preselected distance apart from each other. The distance between the stakes is normally dictated by state or federal regulations and typically depends on the location at which the silt fence is being installed. The length of the stakes is also dictated by state or federal regulations and generally depends on the particular application. The length of the stakes is usually either 2 feet or 3 feet and the distance between the stakes is usually either 6 feet or 7.7 feet.

In the past, the task of installing a silt fence required two people. Before installing a silt fence, a trench is dug which is typically approximately six to eight inches deep and approximately four inches wide. A length of silt fence is then rolled out along the trench in such a manner that a portion of the silt fence covers the trench. One person then places the bottom of the stake in the ground and holds the stake while the other person hammers the stake into the ground with a sledge hammer. The bottom end of the next adjacent stake is then placed in the ground by one person and the upper end of the stake is pulled in a direction away from the first stake by that same person until the fabric material of the silt fence is sufficiently taunt. The stake is then hammered into the ground by the second person while the first person holds it in place.

One of the disadvantages of the prior art method is that it requires two people to install the fence. Another disadvantage of this method is that the person holding the stake as it is being hammered into the ground is at risk of serious bodily injury if the stake breaks or if the person hammering the stake hits the person holding the stake.

Accordingly, a need exists for a method and tool for installing silt fences that allows one person to safely install a silt fence without risking bodily injury.

SUMMARY OF THE INVENTION

The present invention provides a tool for installing silt fences. The tool comprises a leg harness that attaches to the installer's leg and a hook connected to the leg harness which can be attached, or hooked, around a stake. To install a silt fence, the installer first hammers the first stake of the silt fence into the ground. The installer then places the bottom end of the next adjacent stake of the fence into the ground at the appropriate location and distance away from the first stake. The installer then places the hook around the stake such that the hook passes through an opening between the stake and the fabric material. The installer then moves the leg positioned in the leg harness in a direction away from the stake to be installed, thereby causing the upper portion of the stake to be pulled in a direction away from the first stake, which causes the fence to be pulled tautly toward the installer. The installer then hammers the stake into the ground with a hammer, such as a full-sized sledge hammer. The installation method of the present invention does not require the stake to be held by a person as it is hammered into the ground because the hook holds the stake in position as it is being hammered.

In accordance with the preferred of the present invention, the tool comprises a belt that is worn by a person installing silt fences and the leg harness attaches to the belt. The hook is connected to the leg harness by a strap. In accordance with the preferred embodiment, the belt comprises a fastener for fastening the ends of the belt together. The fastener comprises a female connecting device on one end of the belt and a male connecting device on the other end of the belt, which can be inserted into the female connecting device and removably locked in place. The male and female connecting devices each comprise a keying feature which cooperate to lock and unlock the connecting devices to allow the installer to easily don and remove the belt. The leg harness preferably is removably attached to the belt by two straps, each of which have clips on their proximal ends that can be clipped to respective rings fixed to the belt. The distal ends of the straps preferably are removably attached to a circular thigh band, which is designed to encircle the thigh of the installer. The thigh band preferably includes a fastener which is essentially identical to the fastener of the belt for allowing ends of the thigh band to be connected and disconnected. The connecting features of the belt and thigh band allow the installer to easily don and remove the belt and leg harness.

Preferably, the belt, the leg band, and the straps that attach the leg harness to the belt are adjustable in length to allow the installer to adjust the belt and leg harness to fit the installer. The hook preferably is rotatably attached to the thigh band via an adjustable strap. These features of the tool of the present invention allow the distance between the hook and the thigh band to be lengthened or shortened and provide flexibility with respect to movement and positioning of the hook. The belt is preferably comprised of a flexible, durable material, such as Nylon, for example. The belt may also be fitted with various holsters for carrying other tools needed for installing silt fences, such as a staple gun, staples and a knife. These holsters and any other desired accessories may be removably attached to the belt so that they can be easily added or removed as desired.

Other features and advantages of the present invention will become apparent from the following discussion, drawings and claims.

DETAILED DESCRIPTION OF THE INVENTION

Figure 1:
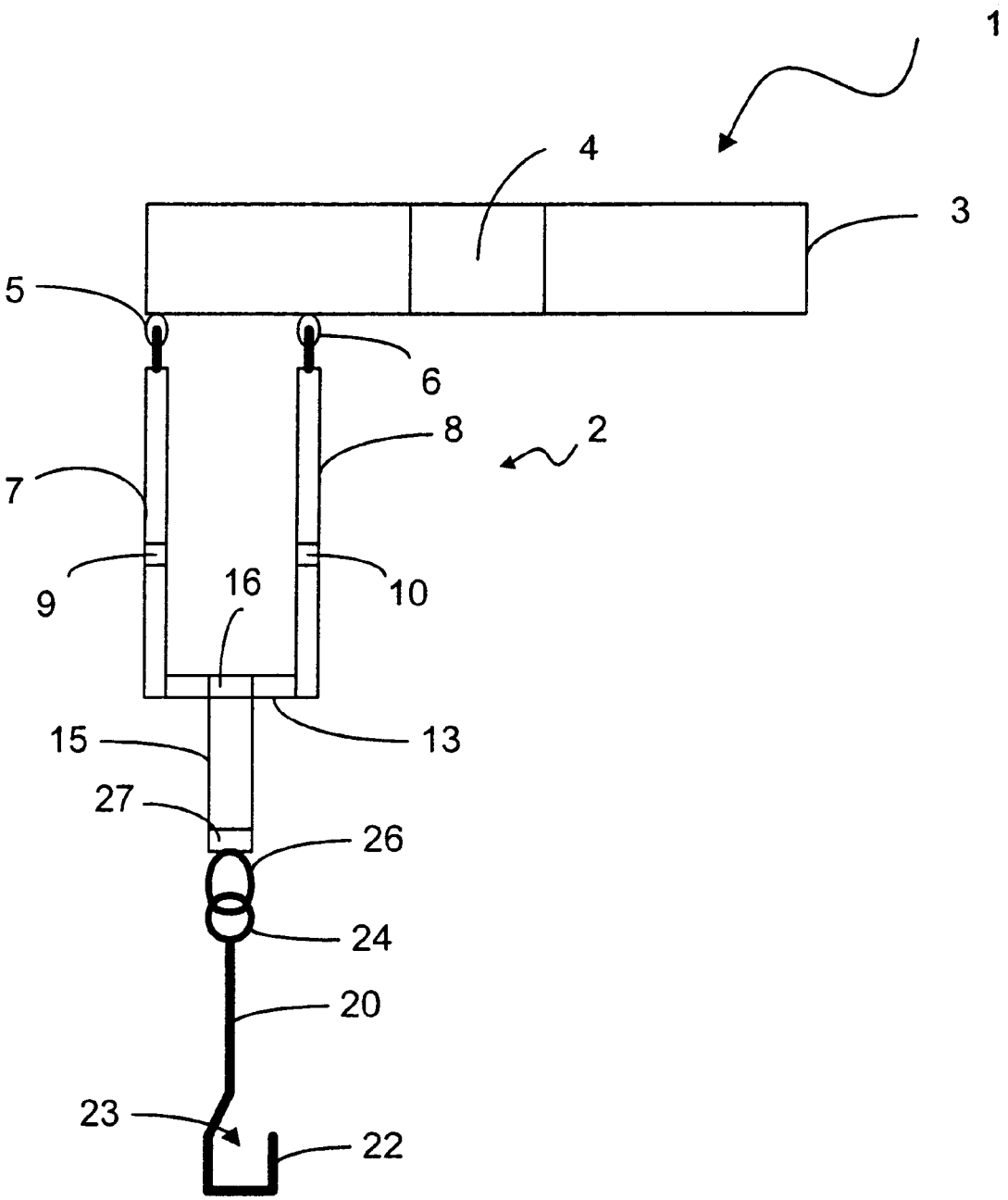
FIG. 1 is a front view of the installation tool of the present invention in accordance with the preferred embodiment.

FIG. 1 illustrates a front view of the preferred embodiment of the installation tool of the present invention. The installation tool 1 of the present invention comprises a belt 3 having first and second ends (not shown) which can be connected together and disconnected via a fastener 4. The fastener 4 preferably comprises a female connecting device (not shown) and a male connecting device (not shown) which can be connected together and disconnected in order to fasten and unfasten the belt 3. The fastener 4 preferably is a typical fastening device comprising a locking and unlocking feature which allows the fastener 4 to be easily locked and unlocked. Preferably, the fastener 4 is comprised of a resilient, durable material, such as plastic or metal. It will be understood by those skilled in the art that the present invention is not limited to the type of fastener used for this purpose and that any type of fastener can be used for this purpose. Furthermore, it should also be noted that the fastener 4 is not an essential element of the tool 1 and that the belt 3 can be comprised as a single endless loop, as will be understood by those skilled in the art.

Preferably, the ends of the belt 3 are connected to the fastener 4 by looping the ends of the belt 3 through their respective male or female connecting device and then attaching any excess portion of the loop to the belt via Velcro™, or some other attachment mechanism. This feature of the tool 1 allows the length of the belt to be easily adjusted to fit the installer's waist size. As stated above, various holsters (not shown) may be attached to the belt 3 to allow the installer to carry other tools, such as a staple gun and staples, which are commonly used in installing silt fences.

The tool 1 of the present invention comprises a leg harness 2 that fits around a leg of the installer (not shown). The leg harness 2 comprises leg straps 7 and 8 and a thigh band 13. The straps 7 and 8 preferably are attached to the belt 3 on their proximal ends via clip/ring fastening mechanisms 5 and 6, respectively. The clips are attached to the straps 7 and 8 and clip onto D rings attached to the belt 3 in the manner shown. It will be understood by those skilled in the art that the straps 7 and 8 may be attached to the belt 3 in any manner and that the straps can be fixedly or removably attached to the belt 3. The clip/ring fastening mechanisms 5 and 6 are the preferred means for attaching the straps 7 and 8 to the belt 3 because they allow the installer to easily unclip the straps from the belt.

The straps 7 and 8 preferably are adjustable in length via buckles 9 and 10 to allow the straps to be adjusted in length to fit the installer's leg. On their distal ends, the straps 7 and 8 are attached to the thigh band 13. The thigh band 13 preferably comprises a fastener (not shown) which is essentially identical to the fastener 4 to allow ends of the thigh band 13 to be easily connected and disconnected, thereby allowing the installer to easily remove the thigh band 13. The thigh band 13 preferably is movably attached to the straps 7 and 8 via loops on the distal ends of the strap 7 and 8 through which the thigh band 13 passes. This feature of the installation tool 1 prevents the leg harness from twisting undesirably during use. It will be understood by those skilled in the art that the thigh band 13 can be fixedly attached to the distal ends of the straps 7 and 8 if so desired and that the thigh band 13 can be attached to the straps 7 and 8 in any desired manner, either fixedly or removably. Preferably, the thigh band 13 is attached to the thigh band fastener in the same manner as the belt 3 is attached to the fastener 4 to allow the thigh band to be adjusted in length.

A strap 15 is attached to the thigh band 13 and a hook 20 is attached to the strap 15. Preferably, the strap 15 is movably attached to the thigh band 13 via a loop 16 formed in the strap 15 which passes around the thigh band 13. This feature of the installation tool 1 allows the strap to be moved vertically with respect to the thigh band 13 and to slide along the thigh band 13, which also prevents undesirable twisting of the leg harness 2. The hook 20 has a hooked end 22 that forms an opening 23 which is shaped for receiving a stake (not shown). The upper end of the hook 20 preferably has an eyelet 24 integrally formed on the hook 20. A ring 26 passes through a loop 27 formed in the distal end of strap 15 and the eyelet 24 of hook 20 is coupled to the ring 26. This coupling arrangement provides the hook 20 with a wide range of movement. It will be understood by those skilled in the art that other coupling arrangements are available and can be used for coupling the hook 20 to the thigh band 13. The hook 20 is preferably comprised of metal, but other resilient materials are suitable for the hook 20 as well, as will be understood by those skilled in the art.

It should be noted that the belt 3 functions to maintain the leg harness 2 on the installer's leg. In accordance with an alternative embodiment of the present invention, the installation tool of the present invention comprises only the thigh band 13, the strap 15, the hook 20, which is coupled to the thigh band 15 in the manner discussed above by the eyelet 24 and ring 26, or by any other suitable means. In accordance with this embodiment, the thigh band 13 fits snugly about the thigh of the installer to prevent the thigh band 13 from sliding off of the installer's leg. It will be understood by those skilled in the art that the hook 20 can be coupled to the thigh band 13 in any desired manner.

Figure 2:
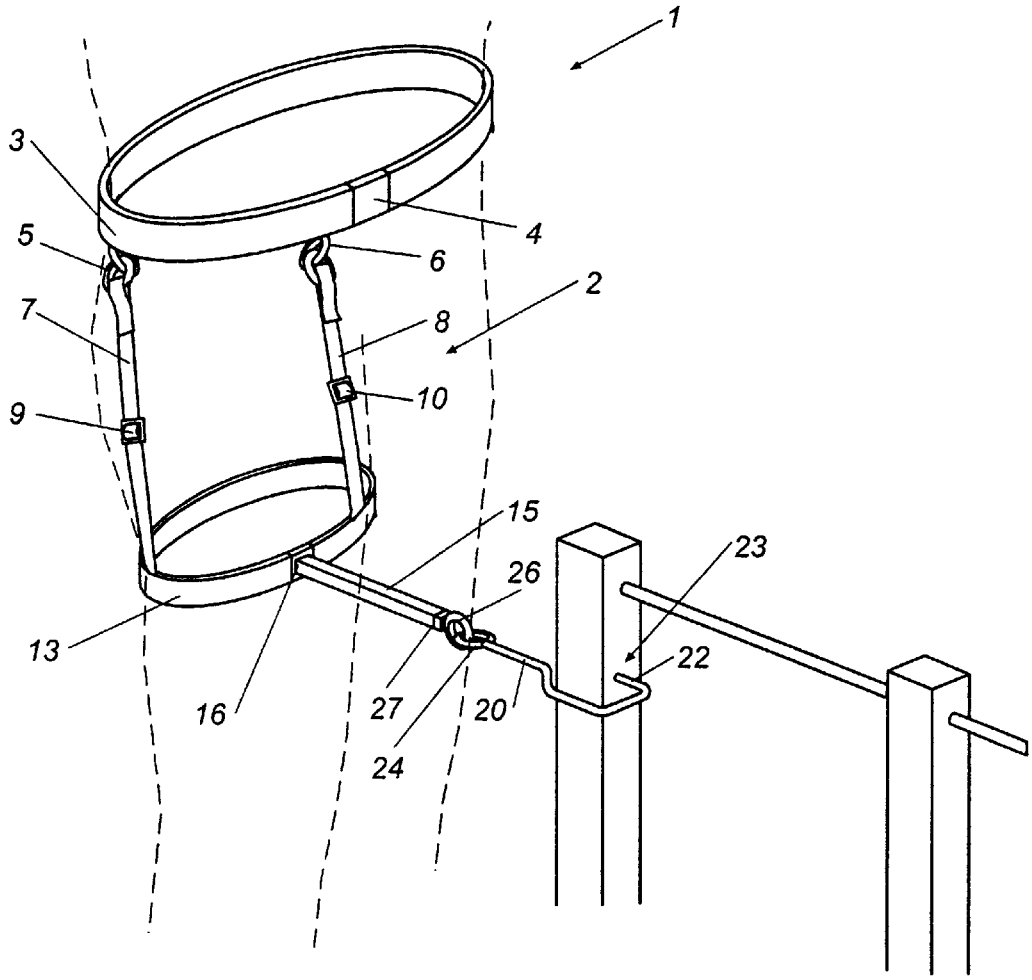
FIG. 2 is a side view of an installer wearing the installation tool shown in FIG. 1 while hammering a stake into the ground.

The manner in which the installation tool 1 is utilized to install a silt fence. In accordance with the preferred embodiment of the present invention, in order to install a silt fence 200, the installer 100 first dons the installation tool 1 by fastening the belt 3 around his or her waist and the thigh band 13 around his or her thigh, preferably just above the knee. As stated above, the thigh band 13, the belt 3 and the straps 7 and 8 can be adjusted to appropriately fit the installer 100. The installer 100 then places the bottom end of the first stake 210 in the ground at the appropriate location and hammers the first stake 100 into the ground. The installer 100 then walks to the second stake 220 and places the bottom end of the second stake 220 in the ground using one hand. The installer 100 then places the hook 20 around the second stake 220 and moves the leg positioned in the leg harness 2 in a direction away from the first stake 210 until the top of the second stake 220 is upright and the silt fence 200 is taut, as illustrated in FIG. 2. As the hook holds the second stake 220 in position, the installer hammers the stake 220 into the ground with hammer 110. The installation tool in accordance with the alternative embodiment is used in a manner which is identical to the manner discussed above with respect to the preferred embodiment.

It should be noted that the present invention has been described with respect to the preferred embodiment, but that the present invention is not limited to the preferred embodiment. It will be understood by those skilled in the art that modifications may be made to the embodiment discussed above without deviating from the spirit and scope of the present invention.

What is claimed is:

1. A tool for installing silt fences comprising:

a belt for attaching the tool about the waist of a installer; a leg harness attached to the belt, the leg harness being designed to be positioned about a leg of the installer; wherein the leg harness comprises a thigh band designed to encircle the thigh of the leg positioned in the leg harness and a plurality of straps, each strap having a first end attached to the belt and a second end attached to the thigh band; and a hook movably attached to the thigh band of the leg harness, the hook being configured with an open end that can be positioned about a stake of the silt fence for holding the stake in place as the installer hammers the stake into the ground.

2. The tool of claim 1, wherein the belt comprises a first end and a second end and a fastener for fastening the first and second ends of the belt together.

3. The tool of claim 1, wherein the thigh band comprises first and second ends and a fastener for fastening the first and second ends of the thigh band together.

4. The tool of claim 1, wherein the first ends of the straps are removably attached to the belt.

5. The tool of claim 2, wherein the belt is adjustable in length.

6. The tool of claim 3, wherein the thigh band is adjustable in length.

7. The tool of claim 4, wherein the straps are adjustable in length.

8. A tool for installing silt fences comprising:

a leg harness designed to be positioned about a leg of the installer, wherein the leg harness comprises a thigh band designed to encircle the thigh of the leg positioned in the leg harness in a friction fit; and a plurality of straps for attaching the thigh band to the leg harness, each strap having a first end attached to the belt and a second end attached to the thigh band;

a hook movably attached to the thigh band of the leg harness, the hook being configured with an open end that can be positioned about a stake of the silt fence for holding the stake in place as the installer hammers the stake into the ground.

9. The tool of claim 8, wherein the thigh band comprises first and second ends and a fastener for fastening the first and second ends of the thigh band together, the fastener comprising means for adjusting the length of the thigh band.

10. The tool of claim 1, wherein the means for attaching the hook to the leg harness comprises a hook strap, the hook strap having a first end attached to the leg harness and a second end attached to the hook.

11. The tool of claim 10, wherein the hook strap is adjustable in length.

12. The tool of claim 10, wherein the first end of the hook strap is attached to the thigh band and the second end of the hook strap is attached to the hook.

13. The tool of claim 8, wherein the means for attaching the hook to the leg harness comprises a hook strap, the hook strap having a first end attached to the leg harness and a second end attached to the hook.

14. The tool of claim 13, wherein the hook strap is adjustable in length.

15. The tool of claim 13, wherein the first end of the hook strap is attached to the thigh band and the second end of the hook strap is attached to the hook.

* * * * *